United States Patent [19]

Rusk

[11] Patent Number: 4,623,048

[45] Date of Patent: Nov. 18, 1986

[54] GOVERNOR FOR CONTROLLING ROTATIONAL SPEED

[76] Inventor: James A. Rusk, 11322 Blue Ridge Blvd. Apt. 2, Kansas City, Mo. 64134

[21] Appl. No.: 655,894

[22] Filed: Sep. 28, 1984

[51] Int. Cl.[4] ..... F16F 57/00; A63G 1/12

[52] U.S. Cl. ..... 188/272; 137/504; 188/280; 188/290; 272/33 R

[58] Field of Search ..... 188/272, 280, 290, 293, 188/266, 296; 187/68; 272/28 R, 28 S, 33 R, 130; 137/504; 417/223, 214, 217, 291, 300; 303/11; 60/431; 254/377, 390; 415/123

[56] References Cited

U.S. PATENT DOCUMENTS

| | | | |
|---|---|---|---|
| 1,654,231 | 12/1927 | Akers | 272/33 R |
| 2,681,713 | 9/1951 | Chambers | 188/293 X |
| 2,716,469 | 8/1952 | Gassot | 188/293 X |
| 3,034,604 | 6/1959 | Holmes | 188/293 X |
| 3,122,162 | 2/1964 | Sands | 137/504 X |
| 3,504,932 | 4/1970 | Kozowyk et al. | 188/266 X |
| 3,519,248 | 7/1970 | Kushiro | 188/272 X |
| 3,549,110 | 12/1970 | Cotton | 188/293 X |
| 4,343,383 | 8/1982 | Brosius | 188/296 |

FOREIGN PATENT DOCUMENTS

| | | | |
|---|---|---|---|
| 2133996 | 8/1984 | United Kingdom | 272/28 R |

*Primary Examiner*—Bruce H. Stoner, Jr.
*Assistant Examiner*—Robert J. Oberleitner
*Attorney, Agent, or Firm*—Zarley, McKee, Thomte, Voorhees & Sease

[57] ABSTRACT

A playground unit having a rotatable horizontally disposed deck adapted to support at least one passenger is provided with a control device operatively connected to the deck to limit the rotational speed thereof. The control device is a hydraulic governor comprising a fluid reservoir, a pump, and a valve with interconnecting fluid lines and check valves providing appropriate directional flow of fluid between the reservoir, pump and valve. The valve automatically moves between an open and closed position depending upon the rotational speed of the unit. The force required to maintain the rotational speed of the playground unit is much greater when the valve is closed as compared to when the valve is open.

7 Claims, 7 Drawing Figures

GOVERNOR FOR CONTROLLING ROTATIONAL SPEED

BACKGROUND OF THE INVENTION

Governors are well known for use on internal combustion engines and other industrial machines having rotating shafts for limiting the rotational velocity of the engine or shaft. However, such governors have not been applied to playground equipment such as merry-go-rounds and the like which are manually powered so as to limit the rotational speed thereof. Such rotating playground equipment is often operated at unsafe speed thus presenting safety hazards to the children playing on such equipment.

Therefore, a primary objective of the present invention is the provision of a manually rotated playground unit having a governor for limiting the rotational speed of the unit.

A further objective of the present invention is the provision of a governor for use on rotating playground equipment which is automatically activated when the rotational speed of the playground unit reaches a predetermined level.

Another objective of the present invention is the provision of a governor for limiting the rotational speed of a rotating playground deck so as to require increased force to maintain the rotational speed of the deck after the governor is activated.

Still a further objective of the present invention is the provision of a governor for controlling the rotational speed of a rotating shaft which is activated when the shaft accelerates to a first predetermined rotational speed and which is deactivated when the shaft decelerates to a second predetermined rotational speed.

A further object of the present invention is the provision of a governor for regulating the rotational velocity of a rotatable shaft which is operative when the shaft rotates in either a clockwise or counterclockwise direction.

Another objective of the present invention is the provision of a governor for controlling rotational speed of an object which utilizes the centrifugal force generated by the rotation of the object.

SUMMARY OF THE INVENTION

The present invention employs a hydraulic governor operably connected to the rotating shaft of a playground deck unit to control the rotational velocity of the deck upon which children ride. The governor system includes a vented fluid reservoir containing hydraulic fluid. A fluid supply line provides fluid communication from the reservoir to a gear pump, while a fluid return line provides fluid communication from the gear pump to the reservoir. A valve is operatively disposed in the return line between the pump and the reservoir and is moveable between a first open position wherein the pump is in fluid communcation with the reservoir and a second closed position wherein the pump is substantially blocked from fluid communication with the reservoir.

The pump is operatively connected to the shaft of the playground unit such that the rotation of the shaft activates the pump. Activation of the pump causes hydraulic fluid to be pumped from the reservoir through the pump to the valve at a rate directly related to the rotational speed of the shaft. When the rotational speed of the shaft reaches a first predetermined level, the valve automatically closes such that the fluid pressure within the pump increases thereby requiring increased force to maintain the rotational speed of the shaft at the first predetermined level. The valve remains closed until the rotational speed of the shaft decreases to a second predetermined level whereat the valve automatically opens such that the fluid pressure within the pump decreases. The force required to achieve and maintain a rotational speed of the shaft at a level between the first and second predetermined levels is less when the valve is open than the force required to achieve and maintain the same rotational speed when the valve is closed.

The governor is operational regardless of whether the shaft is operated in a clockwise or counterclockwise position. Also, the governor is oriented with respect to the shaft such that the centrifugal force developed by the rotating shaft facilitates movement of the valve from the open to the closed position thereby decreasing the effect on the system of temperature induced fluid viscosity changes.

DETAILED DESCRIPTION OF THE DRAWINGS

Figure 1:
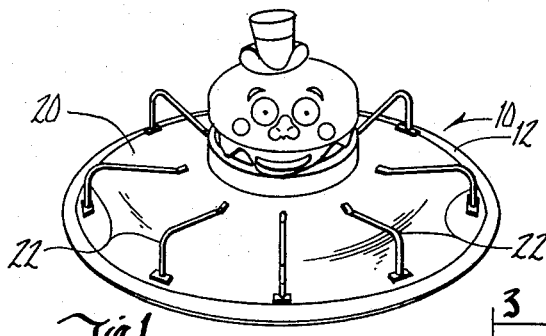
FIG. 1 is a perspective view of a rotatable playground unit.
Figure 2:
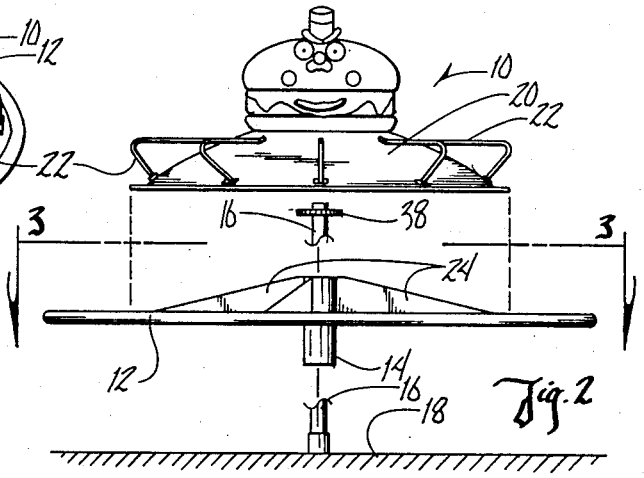
FIG. 2 is an exploded side elevational view of the playground unit.

A rotatable playground unit such as a merry-go-round is generally designated by the numeral 10 in the drawings. Playground unit 10 generally includes a deck 12 having a central hub 14 mounted upon an axle 16 fixed in a support surface 18 such that deck 12 can be rotated upon axle 16. A decorative dome 20 may be secured to deck 12. Handles 22 are provided on playground unit 10 for grasping by children playing on the unit and for facilitating manual rotation of the unit. Ribs 24 may be provided on the top or bottom surface of deck 12 for structural support.

A governor system for controlling the rotational speed of the playground unit 10, or other devices having a rotating shaft, is generally designated by the numeral 26 in the drawings. Governor 26 is mounted upon deck 12 and generally includes a reservoir 28 containing hydraulic fluid, a gear pump 30, and a valve 32. A plurality of hoses 34 interconnect reservoir 28, pump 30 and valve 32 and provide fluid communication therebetween. Check valves 36A, 36B, 36C and 36D are disposed in certain of the hoses 34 to control the directional flow of the fluid therethrough.

Figure 4:
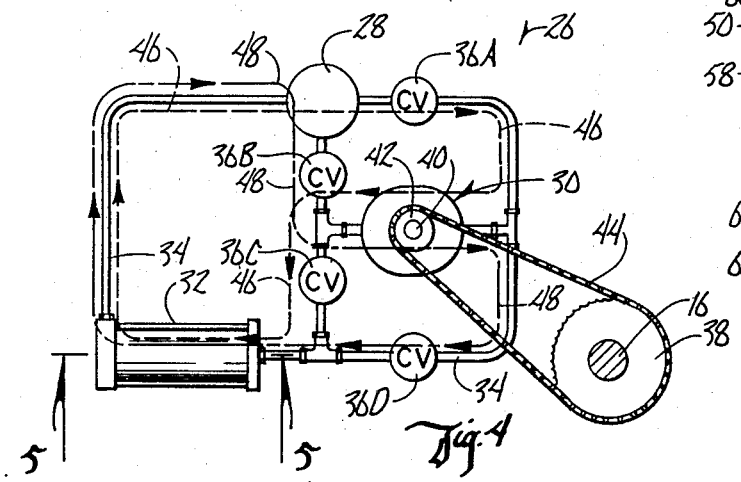
FIG. 4 is a schematic showing the governor system of the present invention.

Axle 16 of playground unit 10 includes a sprocket 38 secured thereto. Pump 30 includes a central shaft 40 with a sprocket 42 connected thereto. A roller chain 44 drivingly connects sprockets 38 and 42 such that rotation of playground unit 10 in either of the clockwise or counterclockwise direction activates pump 30. As seen in FIG. 4, when pump 30 is operated in one direction, both check valves 36A and 36C are open while check valves 36B and 36D are closed to provide a fluid flow in the direction indicated by the arrows 46. On the other hand, when pump 30 is operated in the opposite direction, check valves 36A and 36C are closed while check valves 36B and 36D are open to direct the fluid in the path indicated by arrows 48. The fluid always flows in the same direction through valve 32, while the direction of fluid flow from reservoir 28 through pump 30 depends upon the direction of rotation of axle 16. The gear ratio between sprockets 38 and 42 is preferably on the order of 4 to 1 such that pump 30 operates at a greater speed than the playground unit.

Figure 6:
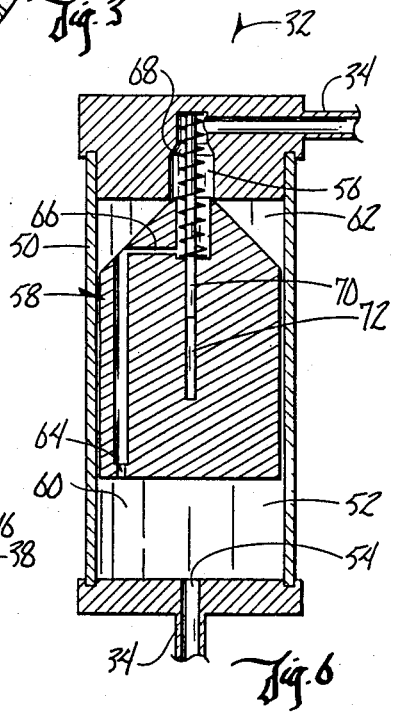
FIG. 6 is a view similar to FIG. 5 showing the valve in a closed position.
Figure 5:
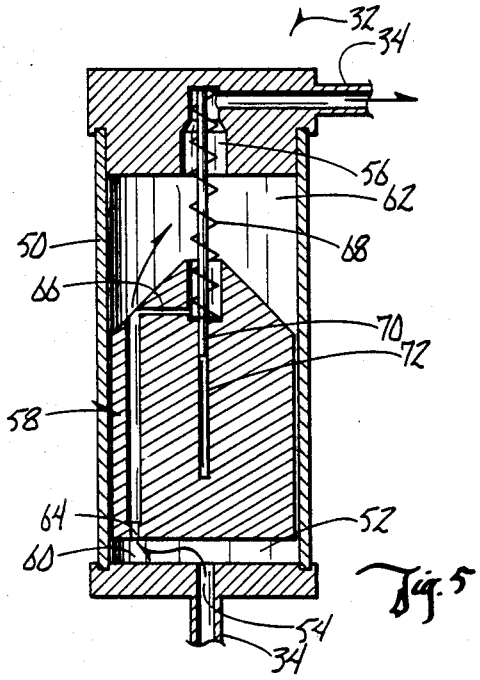
FIG. 5 is an enlarged view taken along lines 5—5 of FIG. 4 showing the valve in an opened position.
Figure 7:
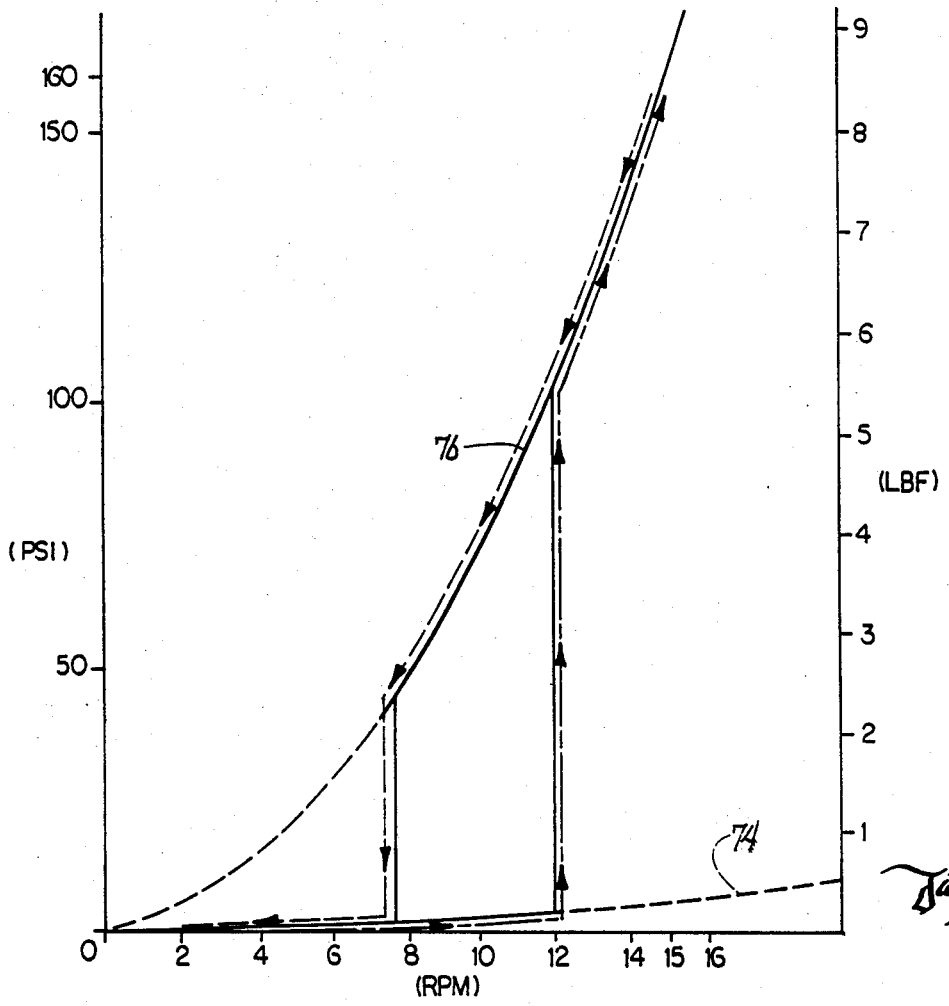
FIG. 7 is an examplary graph showing the hysteresis effect created by the activation of the governor of the present invention.

As seen in FIGS. 5 and 6, valve 32 comprises a housing 50 defining an internal fluid compartment 52 with an inlet port 54 and an outlet port 56. A float or plunger 58 is slidably positioned within compartment 52 so as to define an upstream fluid chamber 60 adjacent inlet port 54 and a downstream fluid chamber 62 adjacent outlet port 56. Plunger 58 has a first activating orifice 64 providing fluid communication between upstream chamber 60 and downstream chamber 62. A second braking orifice 66 in plunger 58 provides communication between downstream chamber 62 and outlet port 56. The diameter of braking orifice 66 is less than that of activating orifice 64 such that the pressure drop across activating orifice 64 is less than the pressure drop across braking orifice 66 for a given rotational speed (RPM) as shown in FIG. 7. Valve 32 also has a compression spring 68 mounted at its opposite ends to outlet port 56 and plunger 58 so as to normally urge plunger 58 toward inlet port 54 when unit 10 is not moving. Spring 68 is mounted over a guide pin 70 which is slidably received within an opening 72 in plunger 58. Pin 70 is co-extensive with longitudinal axis of valve 32. Plunger 58 in moveable from a first open position wherein pump 30 is in fluid communication with reservoir 28, as shown in FIG. 5, to a second closed position wherein plunger 58 is seated against outlet port 56 so as to substantially block the fluid communication between pump 30 and reservoir 28, as shown in FIG. 6.

In operation, rotation of playground unit 10 activates pump 30 such that hydraulic fluid is pumped from reservoir 28, through pump 30, into valve 32 at a rate directly related to the rotational speed of unit 10. As the rotational speed of unit 10 continues to increase, the fluid flow rate pumped by pump 30 into valve 32 increases thereby increasing the pressure in upstream chamber 60 so as to urge plunger 58 against spring 68 towards the closed position of the valve.

When playground unit 10 is accelerated to a first predetermined rotational speed, plunger 58 is forced by the fluid pressure within upstream chamber 60 into sealing engagement with outlet port 56 so as to substantially block outlet port 56 from fluid communication with downstream chamber 62. The large pressure drop across braking orifice 66, created when valve 32 is in such a closed position, creates an increased fluid back pressure upon pump 30 thus requiring a greatly increased force to maintain the speed of unit 10 at the first predetermined level. As seen by the graph in FIG. 7, the pressure drop across activating orifice 64 when valve 32 is open is indicated by the substantially horizontal portion of parabolic curve 74 while the pressure drop across the braking orifice 66 is indicated by the parabolic line 76.

After valve 32 has closed, the cross-sectional area of downstream chamber 62 is slightly less than the cross-sectional area of upstream chamber 60. When the rotational speed of unit 10 decreases, the rate of fluid flow into upstream chamber 60 also decreases thereby reducing the pressure drop across braking orifice 66. When the unit decelerates to a second predetermined rotational speed, the force of spring 68 urges plunger 68 out of seating engagement with outlet port 56 wherein valve 32 is opened. When valve 32 is open, the fluid back pressure upon pump 30 is reduced thereby reducing the force required to rotate the unit.

In more particular reference to the graph shown in FIG. 7, playground unit 10 can be accelerated with minimal force up to a first predetermined rotational speed wherein valve 32 closes and thereby requires additional force to maintain such speed. To eliminate the increased force required to rotate unit 10 when valve 32 is closed, the rotational speed of the unit must be decreased to a second predetermined level whereat the force of spring 68 overcomes the decreased pressure difference between the inlet and outlet ports so as to open valve 32 and thereby reduce the pressure difference between the ports and the back pressure upon pump 30. Preferably, the first predetermined rotational speed level wherein valve 32 closes is approximately 12 revolutions per minute while the second predetermined rotatinal speed level of unit 10 wherein valve 32 opens is in the range of 7–8 revolutions per minute, as seen by the graph in FIG. 7.

Figure 3:
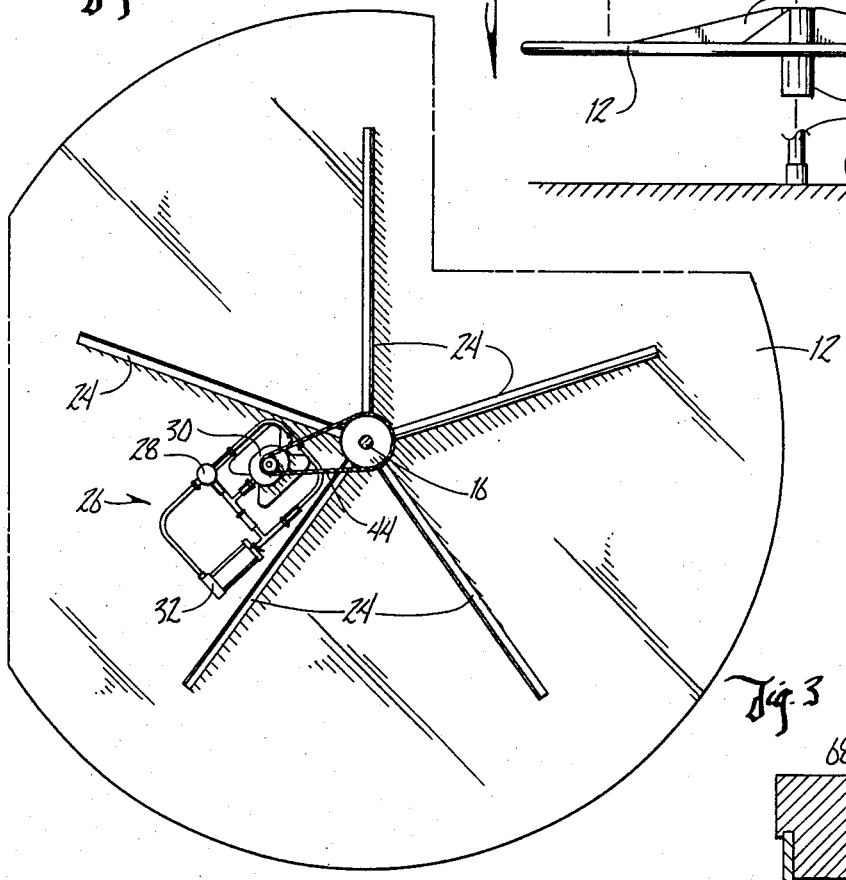
FIG. 3 is a partial top plan view taken along lines 3—3 of FIG. 2.

It can be seen in FIGS. 3 and 4 that the longitudinal axis of valve 32 is perpendicular to that of shaft 14. Such arrangement of the valve allows the centrifugal force developed by increased rotational speeds of the playground unit to facilitate the movement of plunger 58 to the closed seated position against outlet port 56. Thus, the temperature affects upon the viscosity of the hydraulic fluid are minimized.

Thus, the governor of the present invention has a hysteresis effect in that once valve 32 has closed thereby increasing the force required to maintain the rotational speed of the unit, such speed must be reduced to a level below the initial valve-closing speed before valve 32 will open. Such closing and delayed opening of the valve inhibits operation of the playground unit at excessive, unsafe speeds. Also, it is unlikely that a person, particularly a child, can exert for an extended period of time, the force required to rotate the unit at high speeds when valve 32 is closed, therefore resulting in slower, safer playground activity.

The present invention therefore accomplishes at least all of its stated objectives.

What is claimed is:

1. A hydraulic governor for controlling the rotational speed of a shaft rotating continuously in one direction, comprising:

a fluid reservoir containing hydraulic fluid and having inlet and outlet ports;

a pump having an inlet port in fluid communication with said outlet port of said reservoir and having an outlet port;

a valve housing having an internal compartment with a fluid inlet in communication with said outlet port of said pump and a fluid outlet in communication with said inlet port of said reservoir;

valve means slidably mounted within said valve housing for movement between a first open position and a second closed position;

said pump being operatively connected to said shaft such that rotation of said shaft activates said pump;

said valve means moving automatically to said closed position when the rotational speed of said shaft reaches a first predetermined level; and hysteresis means for automatically delaying the movement of said valve means from said closed position to said open position upon reduction of the rotational speed of said shaft from said first predetermined level until the rotational speed of said shaft is further reduced to a second predetermined level such that the force required to maintain the rotational speed of said shaft between said first and second levels is greater when said valve means is in said closed position than when said valve means is in said open position.

2. The governor of claim 1 wherein said governor includes a spring for biasing said valve means toward said open position.

3. The governor of claim 1 further including hydraulic fluid hoses operatively connecting said reservoir to said pump, said pump to said valve housing and said valve housing to said reservoir, respectively, and including a plurality of check valves disposed in said hoses to direct flow of said hydraulic fluid through said pump, valve means, and reservoir.

4. The governor of claim 3 wherein said pump is activated by rotation of said shaft in both a clockwise and counterclockwise direction.

5. The governor of claim 1 wherein said pump is a gear pump.

6. The governor of claim 1 wherein said valve housing has a longitudinal axis which is oriented perpendicular to the longitudinal axis of said shaft such that the centrifugal force developed by the rotating shaft facilitates the movement of said valve means between said open and closed positions.

7. The governor of claim 1 wherein said hysteresis means includes a first passageway providing a first level of fluid communication between said fluid inlet and fluid outlet of said valve housing when said valve means is in said open position, and a second passageway for providing a second level of fluid communication between said fluid inlet and said fluid outlet of said valve housing when said valve means is in said closed position, said second passageway having a smaller cross-sectional area than that of said first passageway such that said second level of fluid communication is less than said first level of fluid communication.

* * * * *